US006607160B2

(12) United States Patent
Lewis et al.

(10) Patent No.: US 6,607,160 B2
(45) Date of Patent: Aug. 19, 2003

(54) EASY LOADING DISPENSER

(75) Inventors: Richard P. Lewis, Marietta, GA (US); Russell C. Taylor, Alpharetta, GA (US); Paul F. Tramontina, Alpharetta, GA (US)

(73) Assignee: Kimberly-Clark Worldwide, Neenah, WI (US)

( * ) Notice: Subject to any disclaimer, the term of this patent is extended or adjusted under 35 U.S.C. 154(b) by 0 days.

(21) Appl. No.: 09/918,120

(22) Filed: Jul. 30, 2001

(65) Prior Publication Data

US 2003/0019971 A1 Jan. 30, 2003

(51) Int. Cl.[7] ..... B65H 20/02
(52) U.S. Cl. ..... 242/564.4; 242/565; 242/580
(58) Field of Search ..... 242/564.4, 564, 242/564.1, 564.3, 565, 566, 596, 596.7, 599.3, 599.4, 580, 579

(56) References Cited

U.S. PATENT DOCUMENTS

| | | | | |
|---|---|---|---|---|
| 515,849 A | | 3/1894 | Wheeler | |
| 2,555,885 A | | 6/1951 | Hope | |
| 2,583,411 A | | 1/1952 | Carlin | |
| 2,643,069 A | | 6/1953 | Carlin | |
| 2,711,860 A | * | 6/1955 | Layton | 242/564 X |
| 2,819,852 A | | 1/1958 | Sarro | |
| 2,873,927 A | * | 2/1959 | McDonald | 242/564.1 X |
| 2,879,012 A | | 3/1959 | Sarro | |
| 2,905,404 A | | 9/1959 | Simmons | |
| 2,948,486 A | | 8/1960 | Epeneter | |
| 3,301,617 A | * | 1/1967 | Goodwin et al. | 242/564.4 |
| 3,623,676 A | | 11/1971 | Eckels | |
| 3,730,409 A | | 5/1973 | Ratti | |
| 3,770,222 A | | 11/1973 | Jespersen | |
| 3,797,769 A | | 3/1974 | Tucker | |
| 3,843,218 A | | 10/1974 | Krueger et al. | |
| 3,861,610 A | * | 1/1975 | Landis et al. | 242/564.1 |
| 3,878,998 A | | 4/1975 | Lazzari | |
| 3,917,191 A | | 11/1975 | Graham et al. | |
| 3,924,476 A | | 12/1975 | Wolcott | |
| 3,998,120 A | | 12/1976 | Granger et al. | |
| 4,010,909 A | | 3/1977 | Bastian | |
| 4,013,240 A | | 3/1977 | Perrin | |
| 4,067,509 A | | 1/1978 | Graham et al. | |
| 4,119,255 A | * | 10/1978 | D'Angelo | 242/564.4 X |
| 4,122,738 A | | 10/1978 | Granger | |

(List continued on next page.)

FOREIGN PATENT DOCUMENTS

| | | |
|---|---|---|
| EP | 0298931 B1 | 7/1988 |
| EP | 0821561 B1 | 10/1996 |
| EP | 1097665 A2 | 7/2000 |
| WO | 94/17714 | 8/1994 |
| WO | 96/24548 | 8/1996 |
| WO | 99/59457 | 11/1999 |
| WO | 01/30226 A1 | 2/2000 |
| WO | 00/40132 | 7/2000 |
| WO | 00/63100 | 10/2000 |
| WO | 00 74546 A | 12/2000 |

*Primary Examiner*—William A. Rivera
(74) *Attorney, Agent, or Firm*—Nancy M. Klembus; Richard M. Shane

(57) ABSTRACT

A dispenser for dispensing rolled materials wherein the dispenser includes a housing adapted to support a roll of material. A cover is attached to the housing, the cover being pivotable upwardly to an open position and pivotable downwardly to a closed position. A first roller may be attached to the housing and a second roller may be attached to the cover. A dispensing opening is formed between the housing and the cover when the cover is in its closed position, so that the leading portion of a roll of material that is placed within the housing may extend over the first roller. When the cover is moved to its closed position, the leading portion is captured in the nip formed between the first roller and the second roller, thus eliminating the need to feed the leading portion of the rolled material through the nip formed by the rollers.

21 Claims, 10 Drawing Sheets

U.S. PATENT DOCUMENTS 4,165,138 A 8/1979 Hedge et al.
4,192,442 A 3/1980 Bastian et al.
4,260,117 A 4/1981 Perrin et al.
4,307,639 A 12/1981 DeLuca
4,317,547 A 3/1982 Graham et al.
4,396,163 A 8/1983 Graham et al.
4,403,748 A 9/1983 Cornell
4,406,421 A 9/1983 Schultz et al.
4,552,315 A 11/1985 Granger
D283,188 S 4/1986 Pool
4,611,768 A 9/1986 Voss et al.
4,614,312 A 9/1986 Del Pino
4,634,192 A 1/1987 Fielding
4,662,576 A 5/1987 Paul
4,664,304 A 5/1987 Wendt et al.
4,666,099 A 5/1987 Hoffman et al.
4,676,131 A 6/1987 Cassia
4,690,344 A * 9/1987 Yokota ..... 242/564.1
4,699,304 A 10/1987 Voss et al.
4,732,306 A 3/1988 Jesperson
4,756,485 A 7/1988 Bastian et al.
4,786,005 A 11/1988 Hoffman et al.
4,790,490 A 12/1988 Chakravorty
4,807,824 A 2/1989 Gains et al.
4,844,361 A 7/1989 Granger
5,061,232 A 10/1991 Bloch et al.
D326,580 S 6/1992 Brazis
D327,193 S 6/1992 Crook et al.
5,158,521 A 10/1992 Singh
5,161,723 A 11/1992 Wirtz-Odenthal
5,244,161 A 9/1993 Wirtz-Odenthal
5,257,711 A 11/1993 Wirtz-Odenthal
5,294,192 A 3/1994 Omdoll et al.
5,375,785 A 12/1994 Boone et al.
5,452,832 A 9/1995 Niada
5,526,973 A 6/1996 Boone et al.
5,558,302 A 9/1996 Jesperson
5,604,992 A 2/1997 Robinson
5,620,148 A 4/1997 Mitchell
5,865,395 A 2/1999 Wei
5,875,985 A 3/1999 Cohen et al.
5,915,645 A 6/1999 Granger
5,924,617 A * 7/1999 LaCount et al. ..... 242/564.4 X
5,979,821 A 11/1999 LaCount et al.
5,979,822 A 11/1999 Morand et al.
6,006,642 A 12/1999 Granger
6,027,002 A 2/2000 Granger
6,032,898 A 3/2000 LaCount et al.
6,070,821 A 6/2000 Mitchell
6,079,305 A 6/2000 Bloch et al.
D428,286 S 7/2000 Phelps et al.
6,092,451 A 7/2000 Granger
6,092,758 A 7/2000 Gemmell
6,098,917 A 8/2000 Cruz
6,102,269 A 8/2000 Elliott et al.
6,189,828 B1 2/2001 Reilly
6,196,102 B1 3/2001 Granger
6,196,493 B1 * 3/2001 Tanaka ..... 242/564.4
6,206,322 B1 * 3/2001 Elliott et al. ..... 242/564.3 X
6,224,010 B1 5/2001 Morand
6,237,871 B1 5/2001 Morand et al.
6,412,655 B1 * 7/2002 Stuetzel et al. ..... 242/564.4 X

* cited by examiner

EASY LOADING DISPENSER

FIELD OF THE INVENTION

The present invention relates to dispensers of rolled products, and more particularly to dispensers comprising features that permit simple and easy loading of a roll of material into the dispenser.

BACKGROUND OF THE INVENTION

Dispensing of rolled paper products such as paper toweling, bathroom tissue and the like is common in commercial facilities such as airports, manufacturing plants and shopping malls. Rolled paper products are dispensed in different types of locations within these facilities, such as restrooms and work areas. In such facilities, it is frequently important to utilize maintenance personnel in an efficient manner, including minimizing the number of visits maintenance personnel must make to these locations as well as minimizing the amount of time required attending to the dispensers on each visit.

During installation of a roll of material into many of the currently available dispensers, maintenance personnel must thread the leading edge of the rolled paper product through a series of rollers so that the product may be dispensed properly. Additionally, some dispensers require that the roll of paper product must be installed in the dispenser so that the roll rotates in a particular direction. If the roll of paper product is not loaded correctly, the product may not be dispensed properly. These types of dispensers require maintenance personnel to take additional time to ensure that the rolled paper product is loaded correctly into the dispenser and threaded properly through the dispensing mechanism.

Thus, it is desirable to utilize a dispenser that permits rolls of paper product to be easily and correctly loaded into the dispenser in a quick and efficient manner.

SUMMARY OF THE INVENTION

The dispenser of the present invention permits the simple and easy loading of rolled of paper products into the dispenser. An embodiment of a dispenser according to the present invention includes a housing that is adapted to support a roll of material. Selected embodiments of the dispenser permit the simultaneous dispensing of a stub roll. A cover may be attached to the housing, the cover being pivotable upwardly to an open position and pivotable downwardly to a closed position. A first roller may be attached to the housing. In particular embodiments, the first roller may be a drive roller. A second roller may be attached to the cover so that, when the cover is in its lowered position, the rollers are adjacent to each other and a nip is formed between the rollers. In some embodiments, the second roller may be a pressure roller.

An actuating mechanism or actuator may be provided which causes the rollers to dispense the rolled material disposed within the housing. A variety of actuating mechanisms may be utilized with the present invention. One such actuating mechanism may be configures so that it engages at least one of the first or second rollers to cause such roller to rotate and dispense rolled materials.

A dispensing opening is formed between the housing and the cover when the cover is in its closed position. In some embodiments, the housing may include a first dispensing region and the cover may include a second dispensing region. The dispensing opening in such an embodiment is formed by the first dispensing region and the second dispensing region when the cover is in its closed position.

To load a roll of material into the housing, the cover is moved to its open position and the roll of material is placed within the housing. The leading portion of that roll of material may extend over the first roller. The cover may then be moved to its closed position. The leading portion of the rolled material is captured in the nip formed between the first roller and the second roller and may extend through the dispensing opening. In such a dispenser, the individual loading the material into the dispenser does not need to take additional time to thread the leading portion of the roll of material through various openings in the dispenser. In such embodiments, the roll may be loaded into the dispenser without regard to the direction of rotation of that roll.

DESCRIPTION

Figure 1:
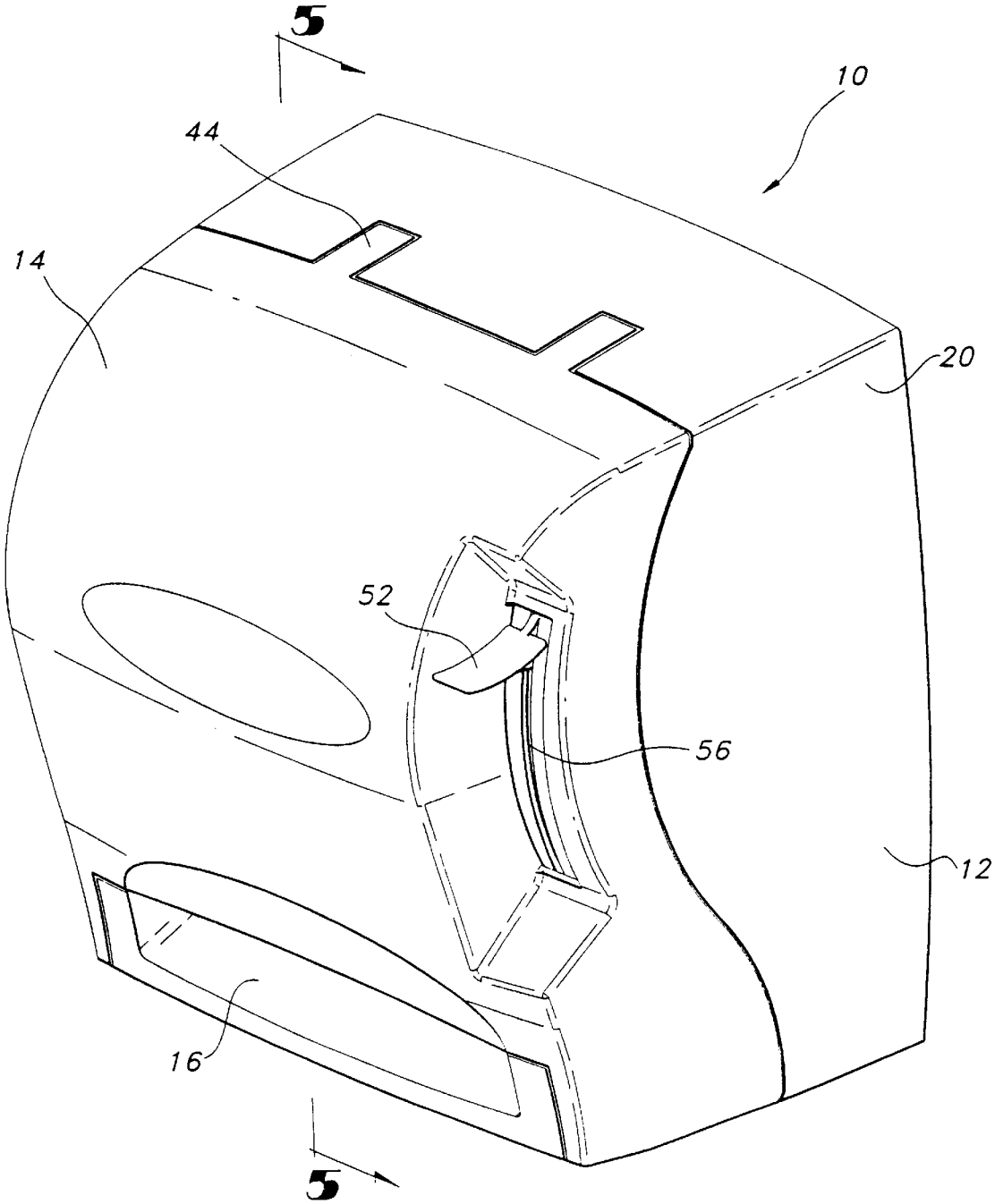
FIG. 1 is a perspective view of an embodiment of the dispenser according to the present invention showing the cover of the dispenser in a closed position.
Figure 2:
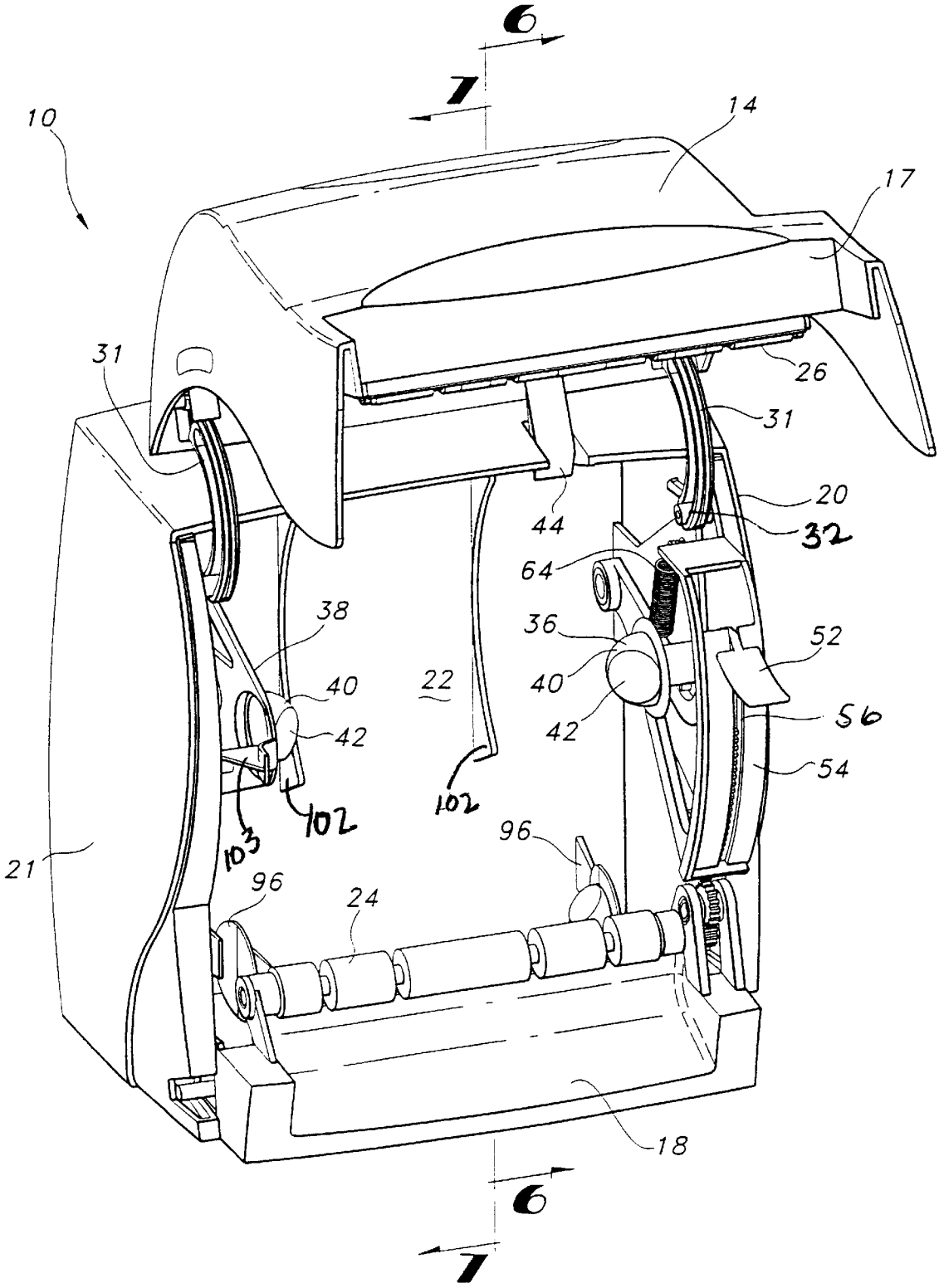
FIG. 2 is another perspective view of an embodiment of the dispenser according to the present invention showing the cover of the dispenser in an open position.

The present invention relates to a dispenser of rolled materials, such as, for example, rolled paper products. An embodiment of a dispenser according to the present invention is depicted in FIG. 1. The dispenser 10 shown therein includes a housing 12, a cover 14 and a dispensing opening 16. As shown in FIG. 2, the housing 12 may include a first side wall 20, a second side wall 21, and a rear wall 22. The cover 14 may be attached to the housing 12 using a variety of mounting schemes. As shown in FIGS. 1 and 2, the cover 14 may be pivotably attached to the housing 12 via one or more hinges 44 and struts 31 so that the cover 14 is pivotable upwardly to an open position and pivotal downwardly to a closed position. In alternate embodiments, the cover may pivot sideways and may be pivotably attached to either the first side wall 20 or the second side wall 21 of the housing 12.

Figure 5:
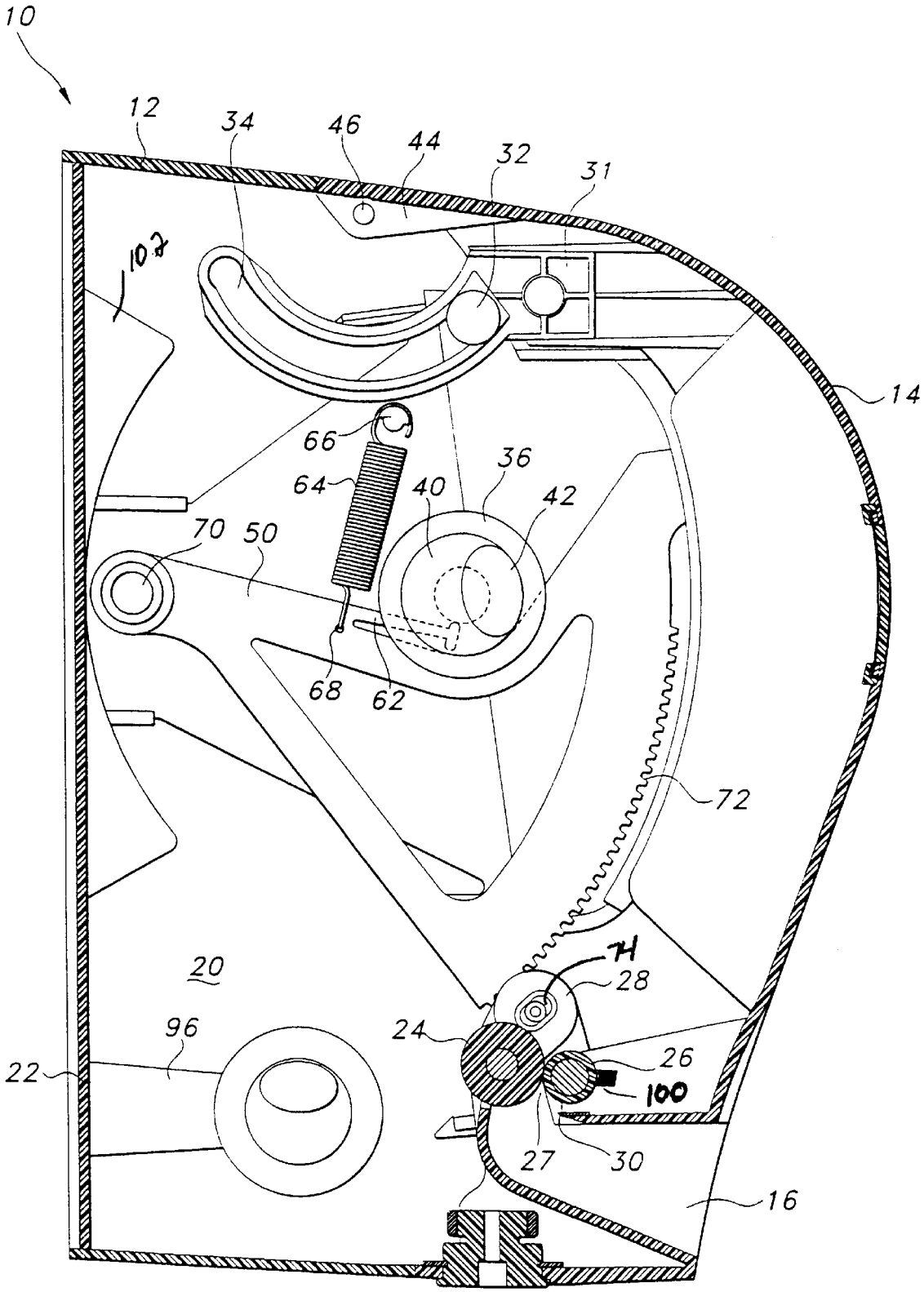
FIG. 5 is a cross-sectional view of the dispenser as shown in FIG. 1, taken along a plane as generally indicated by the line 5—5.
Figure 6:
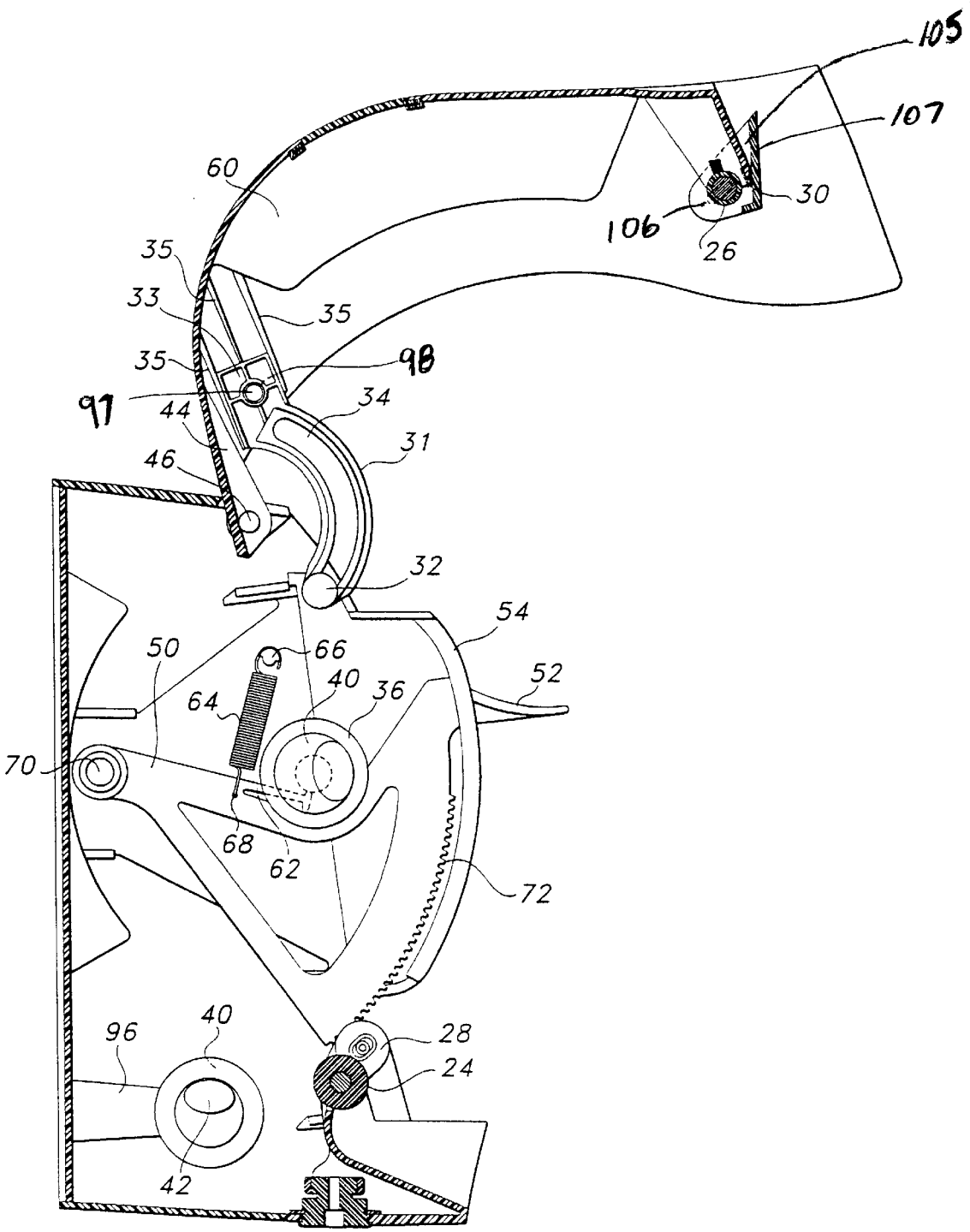
FIG. 6 is a cross-sectional view of the dispenser as shown in FIG. 2, taken along a plane as generally indicated by the line 6—6.

As seen in FIG. 6, the end 33 of the strut 31 is attached to the cover 14. This can be done in many ways, such as, for example, by press-fitting the end 33 into an arrangement of ribs 35 that are disposed on an upper portion of the cover 14. A boss 97 may be provided on the cover 14 that extends through a hole 98 formed in the end 33 of the strut 31. An opening 34 runs along the centerline of a portion of the strut 31 and is configured at one end so that the cover 14 may be retained in its raised position, if desired. For example and as shown in FIG. 5, the end of the opening 34 may be slightly enlarged to retain the cover 14 in its open position. A post 32 may be mounted to the housing 12 so that the post 32 is disposed within the opening 34 of the strut 31. The struts 31 may also be mounted to the cover 14 in other ways to accomplish the same or similar functions. Additionally, as shown in FIGS. 5 and 6, a post 46 may be mounted to the housing 12 so that the post 46 extends through the hinge 44, thereby allowing the hinge 44 to rotate about the post 46 when the cover 14 is removed from the housing 12.

A dispensing opening 16 is formed between the cover 14 and the housing 12. As shown in FIG. 2, a first dispensing region 18 is formed by the housing 12. A second dispensing region 17 is formed by the cover 14. When the cover 14 is lowered to a closed position, the dispensing regions 17 and 18 form the dispensing opening 16.

In some embodiments, a locking system may be included to prevent the dispenser 10 from being opened by unauthorized personnel. Any of a variety of currently available locking systems may be used with the present invention.

As shown in FIGS. 2–7, a first roller 24 may be mounted within the housing 12. The first roller 24 may be what is commonly referred to by those of skill in the art as a nip roller. This roller is stationary with respect to the housing 12. A second roller 26 may be slidably mounted to the lower interior portion of the cover 14. The second roller 26 may be what is commonly referred to by those of skill in the art as the pressure roller. When the cover 14 is lowered to its closed position, the first and second rollers 24 and 26 are adjacent to each other and a nip 27 is formed between the first and second rollers 24 and 26. As shown in FIG. 5, the second roller 26 is urged against the first roller 24 by a spring 100. In some embodiments of the present invention, the pressure roller may be attached to the cover 14 and the nip roller may be attached to the housing 12.

A cutter 30 is provided and, in selected embodiments, is disposed on the cover 14 and is proximate to the second roller 26. The cutter 30 assists a user in severing a portion of rolled material that has been dispensed through the dispensing opening 16. A assortment of different cutting mechanisms may be utilized, and the cutter 30 may be variously positioned within the dispenser to achieve its intended function.

Certain embodiments of the present invention may additionally include a cutting guard 105. As shown in FIG. 6, the cutting guard 105 may be configured and positioned within the dispenser 10 to prevent the cutter 30 from coming into contact with an individual while they are servicing the dispenser 10. While many different configurations of cutting guards may be used in the present invention, in the embodiment disclosed in FIG. 6, the cutting guard is formed as a bracket which is rotatably attached to the cover 14. The sides 106 of the cutting guard 105 are rotatably mounted to the cover 14. An L-shaped wall 107 extends between the two sides 106. When the cover 14 is in its open position, the cutting guard 105 rotates so that the shorter portion of the L-shaped wall 107 is positioned below and in front of the cutter 30. As the cover 14 is moved into its closed position, the cutting guard 107 rotates so that, when the dispenser is in its closed position, the cutting guard has moved away from the cutter 30. In some embodiments, the cutting guard may be moved away from the cutter 30 by a projection on the housing.

The housing 12 is adapted to support a roll of material, and may include a roll support system that rotatably supports the material within the dispenser 10. Although a variety of roll support systems may be used in the present invention, the embodiment depicted in FIGS. 2 and 3 includes a roll support system having a first support 36 and a second support 38. The first and second supports 36 and 38 respectively, may be configured in a variety of ways to achieve their intended purpose.

In particular embodiments, one or more guide ribs 102 may be positioned on the interior surface of the rear wall 22 of the housing 12 that assist in positioning and maintaining the roll of material in its proper location. As shown in FIG. 2, the guide ribs may be arcuate in shape.

The first and second supports, 36 and 38, respectively, may be adapted to support a variety of configurations of rolled paper products. For example, the supports may be configured to engage a coreless roll of paper products or a cored roll of paper products. "Cored" rolls of paper products include a hollow cylindrical core about which the paper product is wrapped. The core is frequently formed of some type of cardboard, which is glued together and to the paper product so that the core stays intact and the product does not separate from the core. "Coreless" rolls of paper products do not include a hollow cylindrical core and are wound throughout the entire diameter of the roll. Such products are described more fully in the following U.S. patents that are incorporated herein in their entirety: U.S. Pat. Nos. 5,620,148; 5,875,985 and 6,070,821.

The first and second supports may, for example, be movable outwardly and away from each other to permit a roll of material to be placed within the dispenser and to permit the supports to contact and retain the roll of material in an appropriate position. To accomplish this, one or both of the supports may be urged toward the other support.

To enable the supports to effectively engage and properly retain the roll of material within the dispenser 10, each such support may include an engaging member 40 disposed proximate to an end of the support. Each engaging member 40 may contact one side of the roll of material to retain the roll in its proper position within the dispenser. For example, in some embodiments, the engaging member 40 would engage the dimpled portion on the side of a coreless roll of material. In particular embodiments where a cored roll of material is positioned within the dispenser 10, the engaging member 40 may be disposed within and engage the core.

Figure 10:
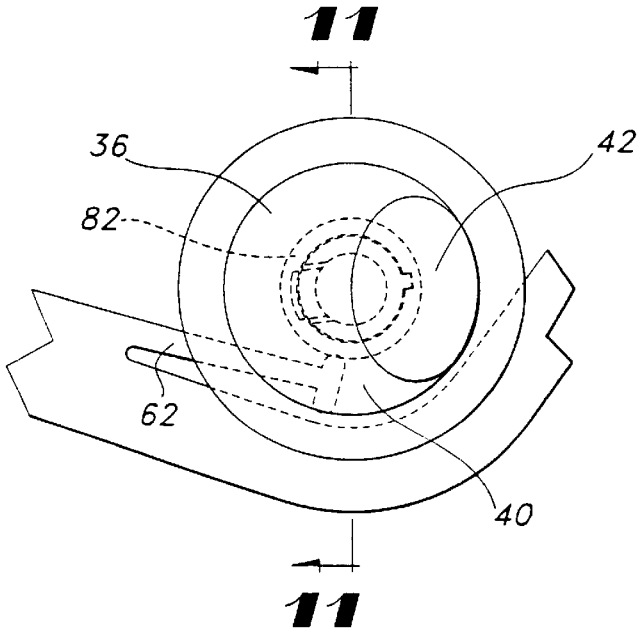
FIG. 10 is a partial view of an embodiment of a support of the present invention.
Figure 11:
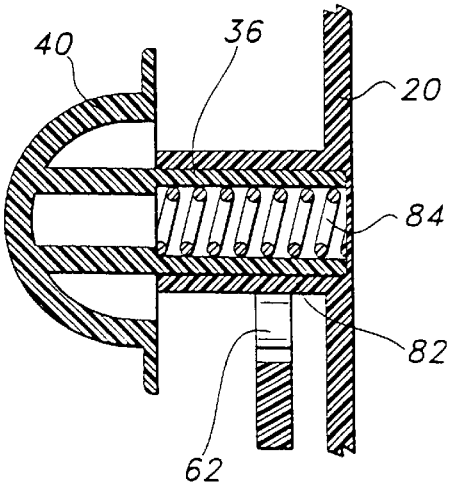
FIG. 11 is a cross-sectional view, taken along a plane as generally indicated by the line 11—11 in FIG. 10 showing the support in its compressed position.

As shown in FIGS. 10 and 11, the first support 36 may be enclosed within a housing such as the cylindrical housing 82. The housing 82 may be attached to the wall 20 of the housing in many different ways, or may be integrally molded with the wall 20. In the embodiment shown in FIG. 11, a spring 84 is disposed within the first support 36. To retain the first support 36 within the housing 82, the spring 84 may be attached at one of its ends to the first support 36 and at its other end to the housing 82 and/or the wall 20. The spring 84 urges the engaging member 40 toward the interior of the housing and toward the second support 38. In FIG. 11, the spring 84 is shown in a compressed state.

Figure 12:
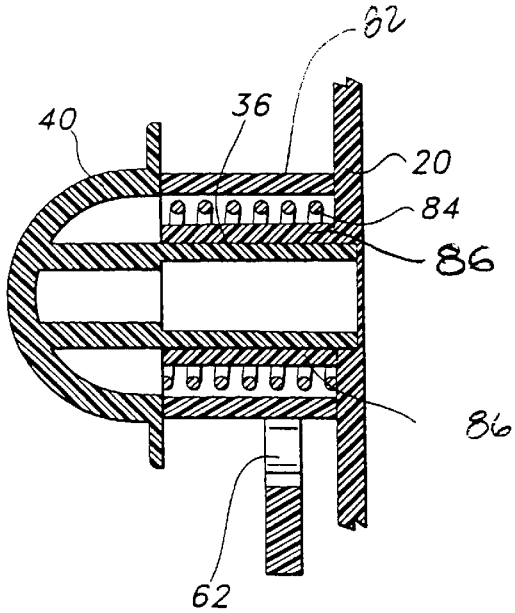
FIG. 12 is a cross-sectional view of another embodiment of a support of the present invention showing the support in its compressed position.

FIG. 12 illustrates another embodiment of the first support 36. A cylindrical housing 82 is provided which includes a cylindrical inner wall 86. The first support 36 extends into the central portion of the housing which is defined at its outer edge by the inner wall 86. The compression spring 84 is disposed between the inner wall 86 and the exterior wall of the housing 82. The spring 84 is attached at one end to the first support 36 and at its other end to the housing 82. In a manner similar to that described above, the spring 84 urges the engaging member 40 toward the interior of the housing and the second support 38.

In selected embodiments, the first support 36 may be mounted to the side wall 20 of the housing 12 so that the engaging member 40 is stationary with respect to the housing 12.

Figure 7:
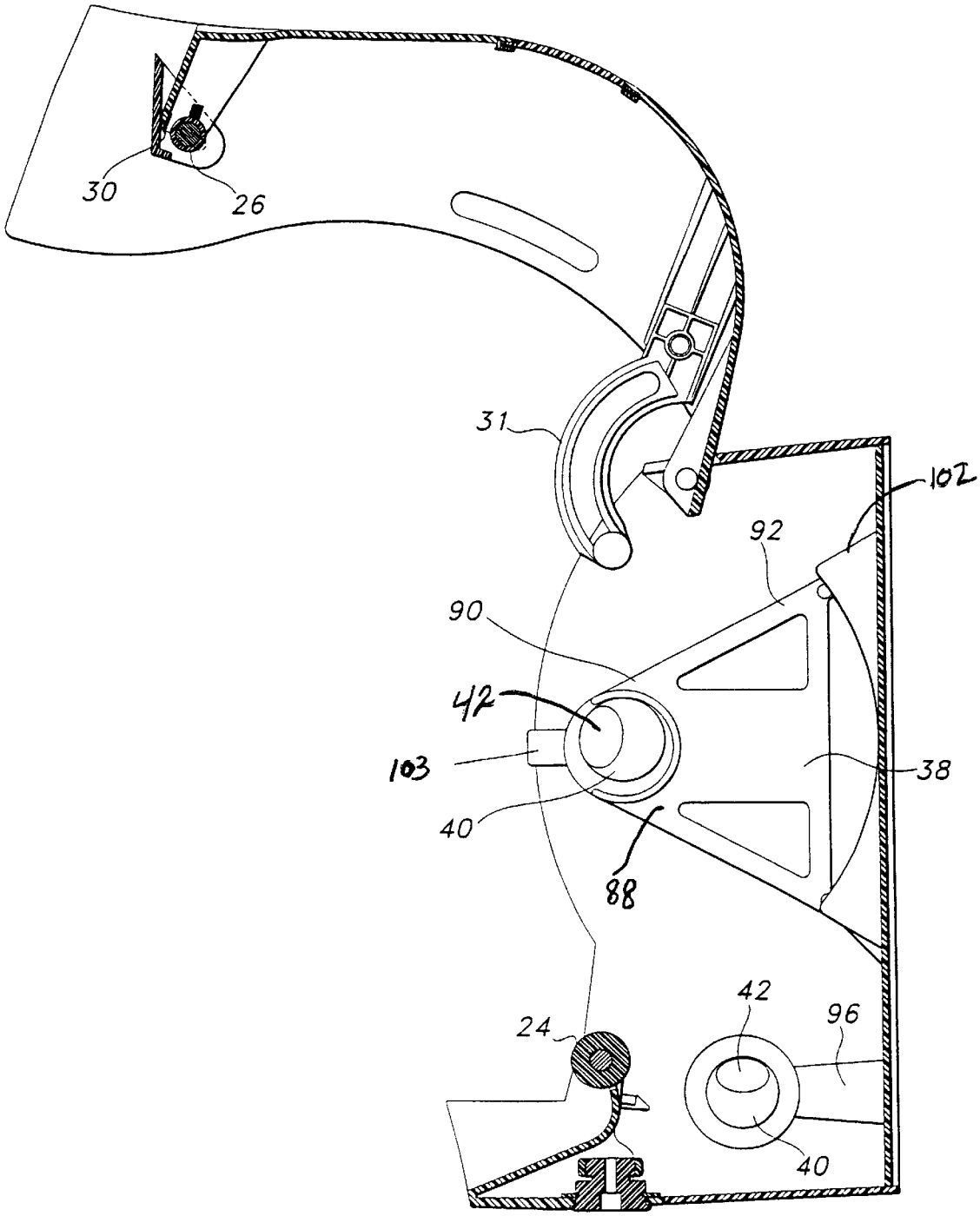
FIG. 7 is a cross-sectional view of the dispenser as shown in FIG. 2, taken along a plane as generally indicated by the line 7—7.

As seen in FIG. 7, the second support 38 may include an elongated arm 88 having forward portion 90 and a rearward portion 92. The second support 38 may include an engaging member 40, and, in some embodiments, the engaging member 40 may be attached to the forward portion 90 of the arm 88. The engaging members 40 may also include a chamfered surface 42 to permit easier installation of a roll of material into the dispenser 10.

Figure 3:
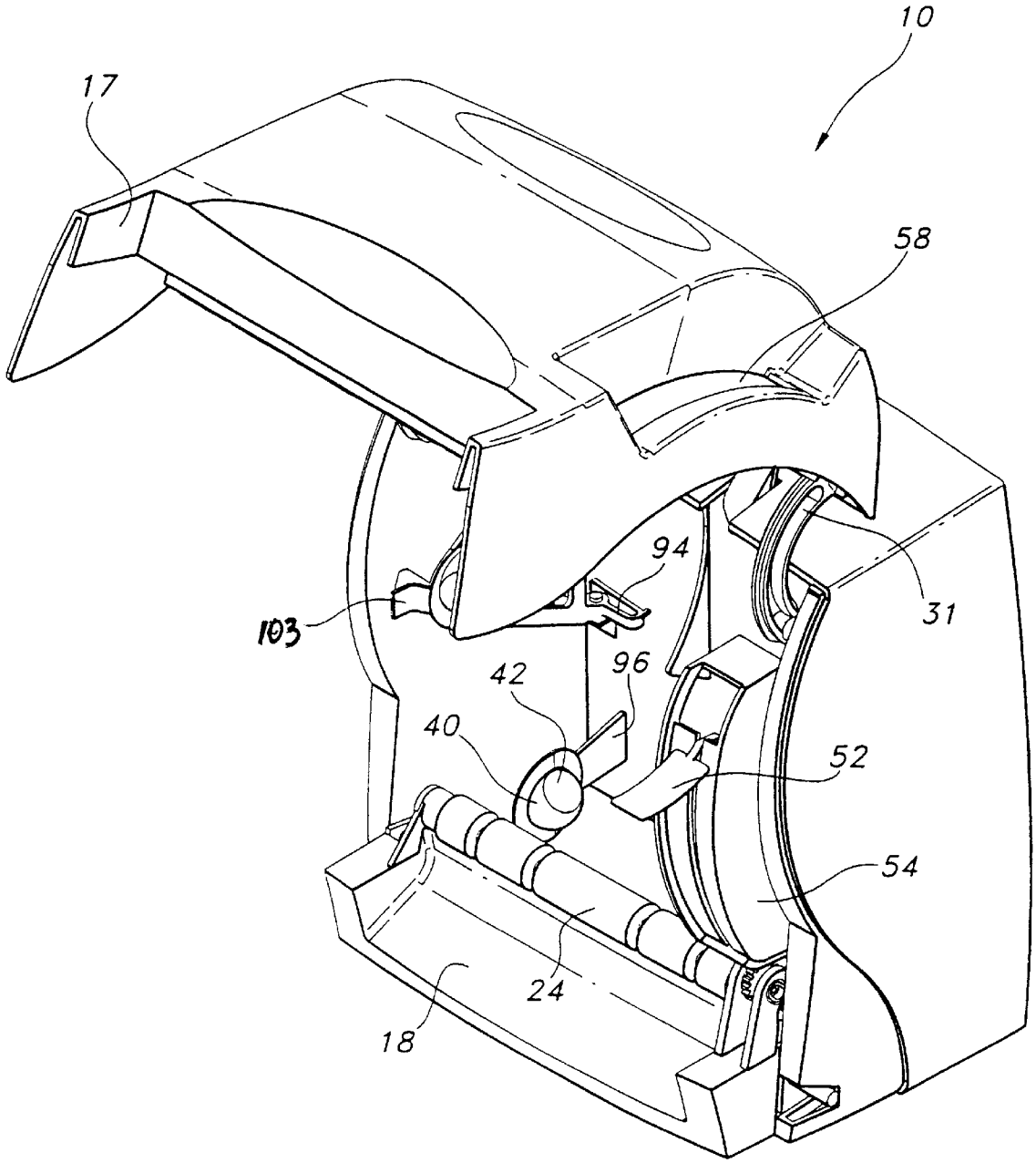
FIG. 3 is yet another perspective view of an embodiment of the dispenser according to the present invention showing the cover of the dispenser in an open position.
Figure 4:
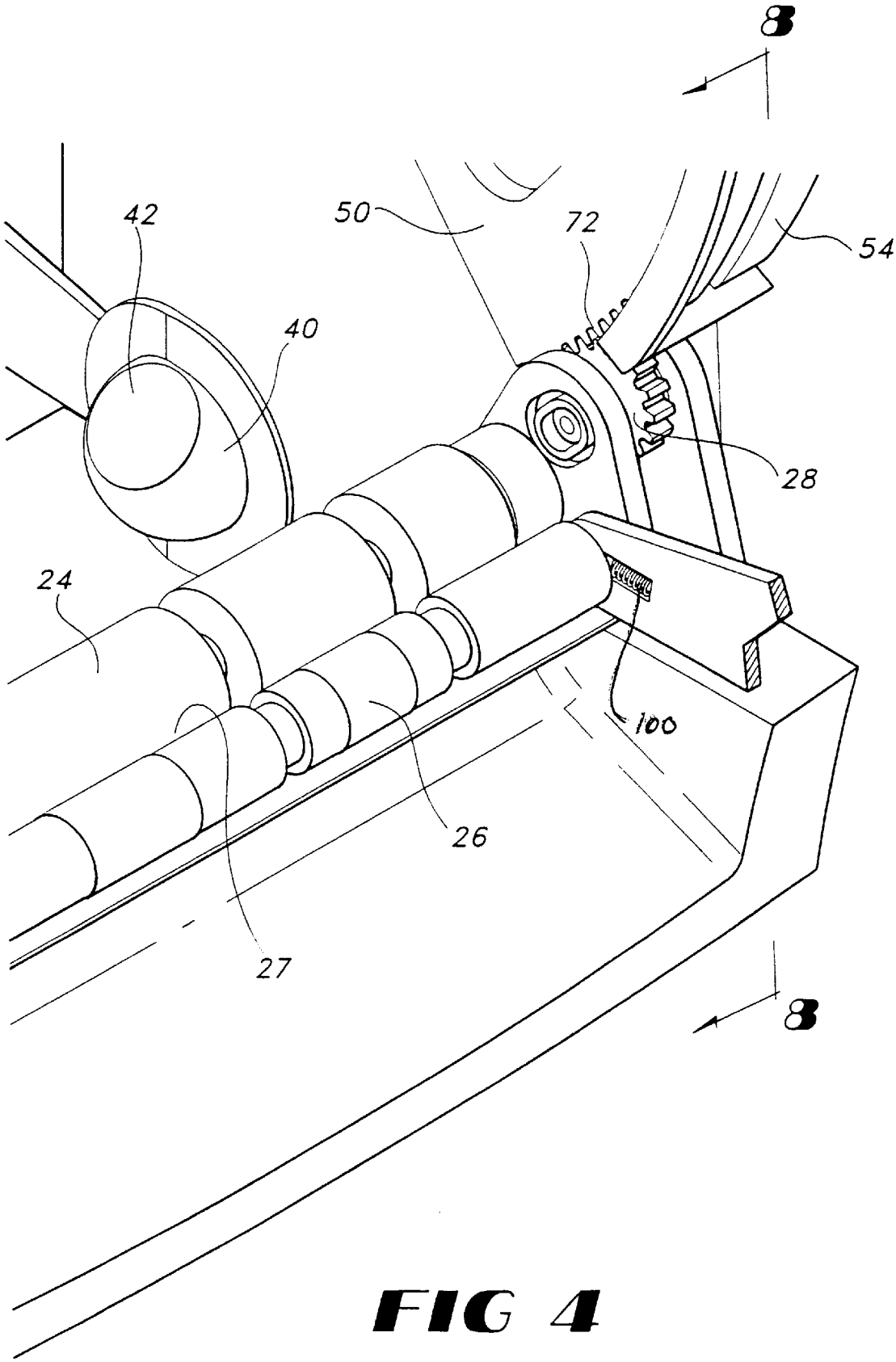
FIG. 4 is a partial perspective cutaway view of the dispensing mechanism of an embodiment of the dispenser according to the present invention.

The rearward portion 92 of the arm 88 may be attached to the housing 12 so that the forward portion 90 is urged toward the interior of the housing 12. Although this can be accomplished by in a variety of ways, the arm 88, as shown in FIG. 3, may be attached to or integrally formed with a spring member 94 which resists movement of the forward portion of the arm 88 inwardly.

In some embodiments, the forward portion 90 of the arm 88 may be configured so that the movement of the arm toward the side wall 21 is limited. As shown in FIGS. 2 and 3, the arm 88 includes a projection 103 positioned on the side of the arm 88 which is facing the side wall 22. The projection 103 prevents the arm 88 from flexing outwardly more than is desired.

In selected embodiments and as shown in FIGS. 1–3 and 5–7, stub roll support members 96 may be provided within the dispenser 10 to permit a partially used roll or "stub" roll to be supported and retained within the dispenser. These stub roll support members may be variously configured, including but not limited to the configurations described above. As shown in FIGS. 5 and 6, the stub roll support member 96 include a flexible arm that is mounted, at one end, to the rear wall 22 of the housing 12. The other end of the flexible arm includes an engaging member 40 to permit proper retention of the stub roll in the dispenser 10.

The stub roll may be inserted into the dispenser in a manner similar to that described above so that the leading edge of the roll is positioned between the rollers 24 and 26, and captured in the nip 27 as the cover 14 is moved to its closed position.

An actuating mechanism or actuator is provided in the present invention that causes the rollers 24 and 26 to rotate and dispense the material that is captured in the nip 27. One particular actuator that is useful in the present invention is described in U.S. Pat. No. 4,192,442, which is incorporated herein in its entirety. A wide variety of actuators may be used with the present invention, including, for example, electronic or automatic actuators.

As shown in FIGS. 2, 5 and 6, the actuating mechanism may include an actuating lever 50 having an actuating handle 52 which extends through a slot 56 in a guide 54. The actuating handle 52 also extends through an aperture 58 in the cover 14. As shown in FIGS. 1 and 3, the aperture 58 may be positioned within a recessed portion 60 of the cover 14. In use, an individual may grasp the actuating handle 52 and draw it downward to dispense material. Other types of actuating handles may be formed as knobs, buttons, and the like.

As seen in FIGS. 5 and 6, the actuating lever 50 may be pivotably attached to the first side wall 20 of the housing 12 at a pivot point 70. This can be accomplished in different ways, including rotatably mounting the lever 50 onto a boss projecting out of the side wall 20. A spring 64 may be provided which is attached at one of its ends to the housing 12 via a boss 66. The other end of the spring 64 may be attached to the actuating lever 50. In some embodiments, the loop on the end of the spring 64 may engage a hole 68 that is formed in the actuating lever 50.

The actuating lever 50 may also include an arm 62, as seen in FIGS. 5, 6 and 10. The spring 64 urges the actuating lever upward. The end of the arm 62 may rest against a portion of the first support 38 when the actuating lever 50 is in its upward-most position, as shown in FIG. 11.

The actuating lever 50 may also include a toothed edge 72 that engages a sliding idler gear 28. The sliding idler gear 28 includes an elongated mounting hole 74 and is mounted to the housing 12 via a pin 76 which extends through the mounting hole 74. The gear 28 in turn may engage the toothed end 25 of the first roller 24, depending on the position and movement of the actuating lever 50.

Figure 8:
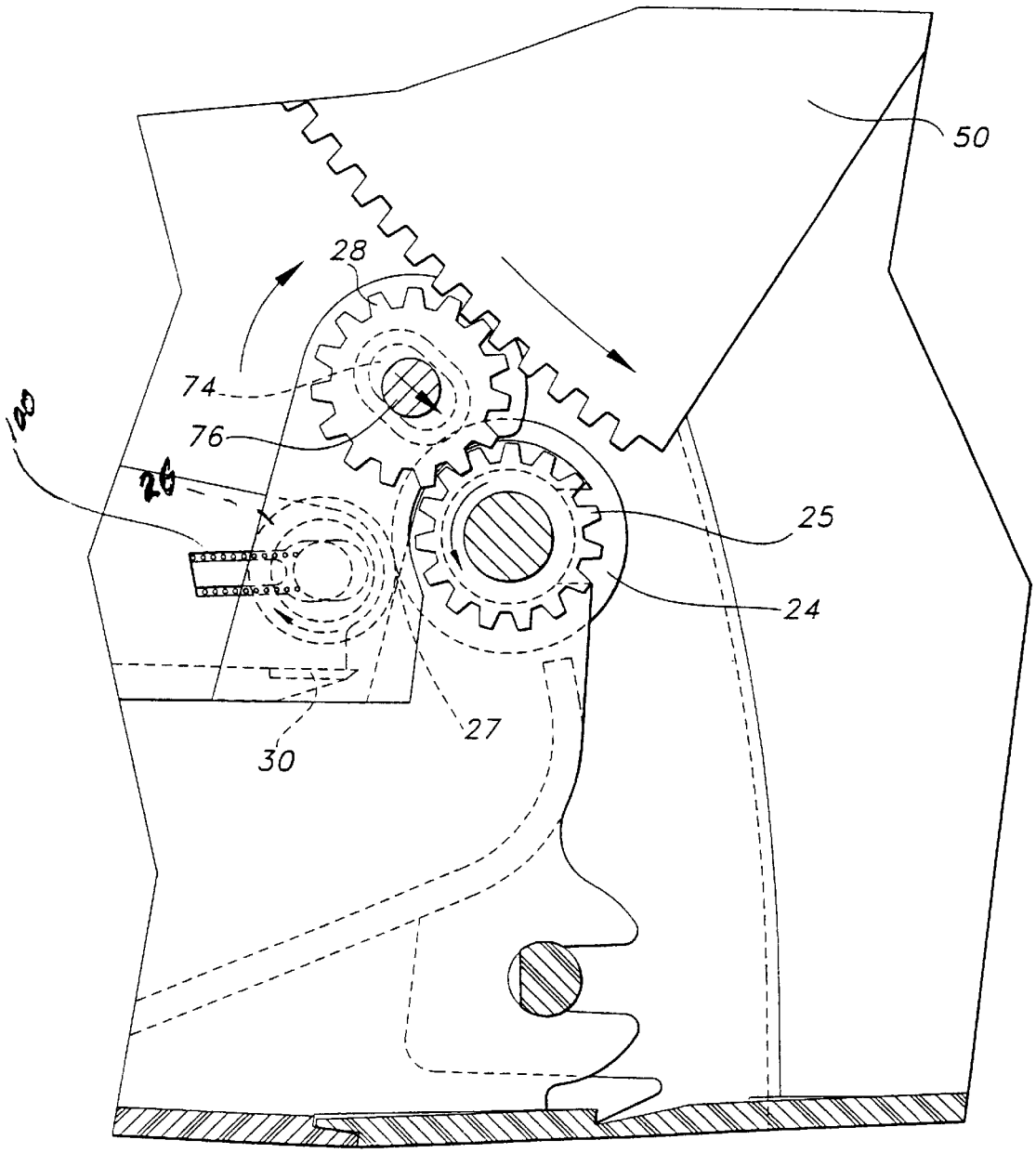
FIG. 8 is a partial cross-sectional cutaway view of an embodiment of the present invention.

As shown in FIG. 8, as the actuating lever 50 is moved downwardly, the toothed edge 72 engages the sliding idler gear 28. The toothed edge 72 causes the gear 28 to move downwardly so that the gear 28 engages the toothed end 25 of the first roller 24. The continued downward movement of the actuating lever 50 and the toothed edge 72 rotates the gear 28 in a clockwise direction. This movement of the gear 28 causes the first roller 24 to rotate in a counterclockwise direction, as indicated by the arrows in FIG. 8. The counterclockwise rotation of the first roller 24 may, in particular embodiments, cause clockwise movement of the second roller 26. The material disposed within the nip 27 is thus moved downwardly and out of the dispenser 10.

Figure 9:
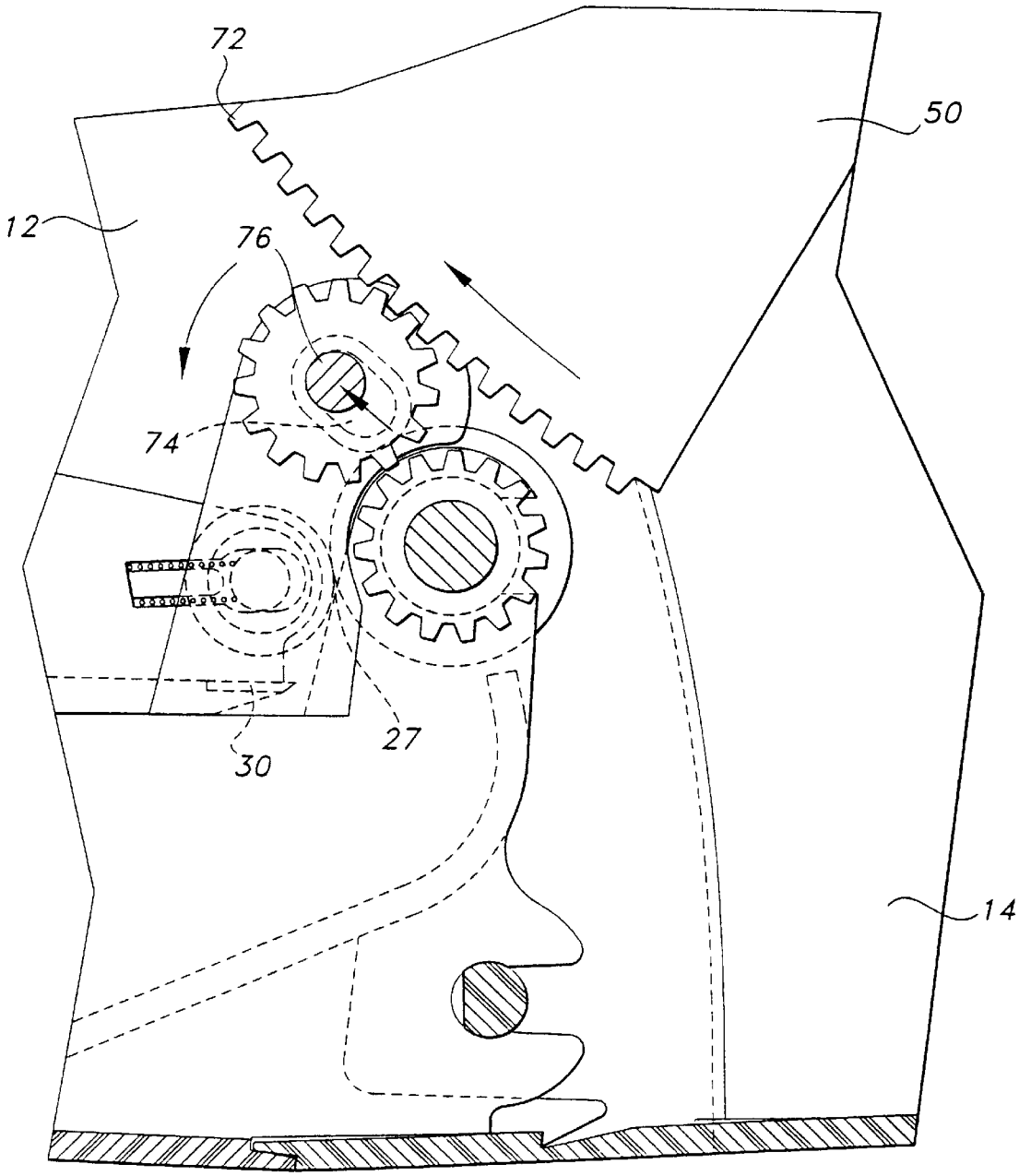
FIG. 9 is another partial cross-sectional cutaway view of an embodiment of the present invention.

As the actuating lever 50 is released, the spring 64 urges the actuating lever 50 upwardly. As seen in FIG. 9, the toothed edge 72 moves upwardly, sliding the gear 28 out of engagement with the toothed end 25 of the first roller 24 and toward its upward position. In this manner, the actuating lever 50 returns to its original position while permitting the first roller 24 to remain stationary and the material to be retained within the nip 27. The user may then pull the dispensed material toward the cover 14 of the dispenser 10, where the dispensed material is separated from the roll of material by the cutter 30.

To service an embodiment of a dispenser according to the present invention, the cover 14 is moved to its open position. If a partially used roll of material is disposed within the dispenser 10, that roll may be removed from the first and second roll supports, 36 and 38, respectively. The partially used roll or "stub" roll may be positioned within the dispenser 10 so that the sides of the stub roll engage the stub roll supports 96. The stub roll may be oriented so that it rotates in either a clockwise or a counterclockwise direction. At least a portion of the stub roll material is positioned so that is extends over the first roller 24. The leading edge of the stub roll may be pulled outwardly after the stub roll has engaged the stub roll support members 96 so that the stub roll material extends over the first roller 24.

To insert a new roll of material, the roll may be held so that the sides of the roll are roughly parallel to the sides 20 and 21 of the housing 12. The new roll of material may be oriented so that it rotates in either a clockwise or a counterclockwise direction. As the roll of material is moved into the housing 12, the sides of the roll may engage the chamfered surfaces 42 of the first and second roll supports, 36 and 38, respectively. One or both of the roll supports may be urged away from the sides of the roll until the roll is sufficiently inserted into the housing 12 so that the engaging members 40 engage the central portion of the roll. The roll of material is placed within the housing 12 so that a portion of the material is positioned over the first roller 24. The leading edge of the material may also be positioned within the dispensing portion 18 of the housing 12.

The cover 14 may then be moved to its closed position. As the second roller 26 is moved downwardly and adjacent to the first roller 24, the material is retained within the nip 27, thus eliminating the need to feed the leading edge of the material between the rollers before moving the cover 14 to its closed position.

The invention may be embodied in other specific forms without departing from the scope and spirit of the inventive characteristics thereof. The present embodiments therefore are to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A dispenser for dispensing rolled materials, the dispenser comprising:

a housing;

a roll support system including (i) a first support attached to the housing, the first support comprising a first engaging member including a first chamfered surface, and (ii) a second support attached to the housing, wherein the first support is movable away from the second support, and further wherein the first support is urged toward the second support;

a cover attached to the housing, the cover being pivotable upwardly to an open position and pivotable downwardly to a closed position;

a cutter disposed on the cover;

a cutting guard rotatably attached to the cover;

a first roller attached to the housing:

a second roller attached to the cover so that, when the cover is in its lowered position, the rollers are adjacent to each other and a nip is formed between the rollers;

an actuator adapted to engage the first or second roller to cause such roller to rotate; and a dispensing opening formed between the housing and the cover when the cover is in its closed position.

2. The dispenser according to claim 1 wherein the cutting guard rotates to cover the cutter when the cover is in the open position, and further wherein the cutting guard rotates to expose the cutter when the cover is in the closed position.

3. The dispenser according to claim 1 wherein the first support further comprises a first rearward portion attached to the housing and a first forward portion being urged toward the second support, wherein the first engaging member is attached to the first forward portion.

4. The dispenser according to claim 1 wherein the second support comprises a second engaging member, wherein the second support is movable away from the first support, and further wherein the second support is urged toward the first support.

5. The dispenser according to claim 4, the second engaging member comprising a second chamfered surface.

6. The dispenser according to claim 1 further comprising at least one stub roll support.

7. The dispenser according to claim 1, the actuator comprising an actuating lever comprising an actuating handle which extends through an aperture in the cover, the actuating lever being pivotably attached to the housing, the actuating lever further comprising a toothed edge, a guide through which the actuating handle extends, the guide including a slot, and a sliding idler gear slidably attached to the housing so that the gear is movable between one position where it engages the toothed edge of the actuating lever and another position where it does not engage the toothed edge of the actuating lever.

8. The dispenser according to claim 1, the housing further comprising a first dispensing region and the cover further comprising a second dispensing region, the dispensing opening formed by the first dispensing region and the second dispensing region when the cover is in its closed position.

9. A dispenser for dispensing rolled materials, the dispenser comprising:

a housing comprising a first dispensing region;

a roll support system;

a cover comprising a second dispensing region, the cover being movable between a closed position and an open position;

a dispensing opening formed by the first dispensing region and the second dispensing region when the cover is in its closed position;

a first roller attached to the housing;

a second roller attached to the cover so that, when the cover is in its open position, the first and second rollers are spaced apart from each other, and when the cover is in its closed position, the first and second rollers are adjacent to each other and a nip is formed between the rollers;

a cutter disposed on the cover;

a cutting guard configured to prevent contact with the cutter when the cover is in its open position; and an actuating mechanism adapted to engage the first or second roller to cause such roller to rotate and dispense rolled materials.

10. The dispenser according to claim 9, wherein the cutting guard comprises:

first and second sides rotably mounted to the cover; and a wall extending between the first and second sides;

wherein the cutting guard rotates to cover the cutter when the cover is in the open position, and further wherein the cutting guard rotates to expose the cutter when the cover is in the closed position.

11. The dispenser according to claim 9, the roll support system comprising (i) a first support attached to the housing, the first support including a first engaging member comprising a first chamfered surface, and (ii) a second support attached to the housing, wherein the first support is movable away from the second support, and further wherein the first support is urged toward the second support.

12. The dispenser according to claim 11 wherein the first support further comprises a first rearward portion attached to the housing and a first forward portion being urged toward the second support, wherein the first engaging member is attached to the first forward portion.

13. The dispenser according to claim 11 wherein the second support comprises a second engaging member, wherein the second support is movable away from the first support, and further wherein the second support is urged toward the first support.

14. The dispenser according to claim 13, the second engaging member comprising a second chamfered surface.

15. The dispenser according to claim 9, the actuating mechanism comprising an actuating lever comprising an actuating handle which extends through an aperture in the cover, the actuating lever being pivotably attached to the housing, the actuating lever further comprising a toothed edge, a guide through which the actuating handle extends, the guide including a slot, and a sliding idler gear slidably attached to the housing so that the gear is movable between one position where it engages the toothed edge of the actuating lever and another position where it does not engage the toothed edge of the actuating lever.

16. A dispenser for dispensing rolled materials, the dispenser comprising:

a housing comprising a dispensing region;

a roll support system including a first support attached to the housing, the first support comprising a first engaging member including a first chamfered surface, and a second support attached to the housing, wherein the first support is movable away from the second support, and further wherein the first support is urged toward the second support;

a cover comprising a dispensing region, the cover being movable between a closed position and an open position;

a cutter disposed on the cover;

a cutting guard rotatably attached to the cover;

a dispensing opening formed by the dispensing region of the housing and the dispensing region of the cover when the cover is in its closed position;

a drive roller attached to the housing and disposed above the dispensing region of the housing;

a pressure roller attached to the cover so that, when the cover is in its open position, the pressure roller is spaced apart from the drive roller and when the cover is in its closed position, the rollers are adjacent to each other and a nip is formed between the rollers; and an actuator adapted to rotate the drive roller and dispense rolled materials.

17. The dispenser according to claim 14 wherein the cutting guard comprises:

first and second sides rotably mounted to the cover; and an L-shaped wall having a short portion and a long portion, the short and long portions extending between the first and second sides;

wherein the short portion of the L-shaped wall covers the cutter when the cover is in the open position, and further wherein the cutting guard rotates to expose the cutter when the cover is in the closed position.

18. The dispenser according to claim 14 wherein the first support further comprises a first rearward portion attached to the housing and a first forward portion being urged toward the second support, wherein the first engaging member is attached to the first forward portion.

19. The dispenser according to claim 14 wherein the second support comprises a second engaging member, wherein the second support is movable away from the first support, and further wherein the second support is urged toward the first support.

20. The dispenser according to claim 19, the second engaging member comprising a second chamfered surface.

21. The dispenser according to claim 16, the actuator comprising an actuating lever comprising an actuating handle which extends through an aperture in the cover, the actuating lever being pivotable attached to the housing, the actuating lever further comprising a toothed edge, a guide through which the actuating handle extends, the guide including a slot, and a sliding idler gear slidably attached to the housing so that the gear is movable between one position where it engages the toothed edge of the actuating lever and another position where it does not engage the toothed edge of the actuating lever.

* * * * *